US012692665B2

(12) United States Patent
Markelz et al.

(10) Patent No.: US 12,692,665 B2
(45) Date of Patent: Jul. 28, 2026

(54) TRACK SWITCH

(71) Applicant: Bridge and Track Crane LLC, Cary, IL (US)

(72) Inventors: Paul Markelz, Cary, IL (US); William Kenneth Quast, Aurora, IL (US)

(73) Assignee: BRIDGE AND TRACK CRANE LLC, Carl, IL (US)

( * ) Notice: Subject to any disclaimer, the term of this patent is extended or adjusted under 35 U.S.C. 154(b) by 678 days.

(21) Appl. No.: 17/796,803

(22) PCT Filed: Jan. 25, 2021

(86) PCT No.: PCT/US2021/014944
§ 371 (c)(1),
(2) Date: Aug. 1, 2022

(87) PCT Pub. No.: WO2021/151089
PCT Pub. Date: Jul. 29, 2021

(65) Prior Publication Data

US 2023/0047139 A1 Feb. 16, 2023

Related U.S. Application Data

(60) Provisional application No. 63/041,323, filed on Jun. 19, 2020, provisional application No. 62/965,679, filed on Jan. 24, 2020.

(51) Int. Cl.

| | |
|---|---|
| ***E01B 7/00*** | (2006.01) |
| ***E01B 23/00*** | (2006.01) |
| ***E01B 23/06*** | (2006.01) |

(52) U.S. Cl.
CPC ..... *E01B 7/00* (2013.01); *E01B 23/00* (2013.01); *E01B 23/06* (2013.01)

(58) Field of Classification Search
CPC . E01B 23/06; E01B 7/00; E01B 23/00; E01B 25/26; A63H 19/32
See application file for complete search history.

(56) References Cited

U.S. PATENT DOCUMENTS 574,285 A * 12/1896 Tague ..... E01B 7/00 246/376
741,896 A * 10/1903 Eddy ..... E01B 7/14 246/429

(Continued)

FOREIGN PATENT DOCUMENTS

CN 202626775 U 12/2012
CN 106414848 A 2/2017

(Continued)

OTHER PUBLICATIONS

International Search Report and Written Opinion issued on corresponding PCT Application No. PCT/US2021/014944, mailed Apr. 6, 2021.

*Primary Examiner* — Cheng Lin
(74) *Attorney, Agent, or Firm* — Quarles & Brady LLP

(57) ABSTRACT

A track switch includes a turntable section, one or more track sections coupled together to form a single track, and a pair of ramp sections coupled to opposing ends of the single track. One of the track sections is rotationally coupled to the turntable section to allow ramp sections to rotate relative to the turntable section and selectively connect a first railroad track to a second railroad track.

19 Claims, 16 Drawing Sheets

(56) References Cited

U.S. PATENT DOCUMENTS

| | | | | | |
|---|---|---|---|---|---|
| 824,271 | A * | 6/1906 | Aldrich | E01B 23/06 | 238/12 |
| 1,043,427 | A * | 11/1912 | Holmes | E01B 7/30 | 246/378 |
| 2,782,733 | A * | 2/1957 | Ewing | B61D 47/005 | 410/1 |
| 2,967,440 | A | 1/1961 | Hunter | | |
| 7,434,768 | B2 * | 10/2008 | Humphrey | E01B 23/00 | 246/429 |
| 9,074,325 | B2 * | 7/2015 | Gehringer | E01B 23/00 | |
| 9,644,325 | B2 * | 5/2017 | Mancic | E01B 25/12 | |
| 11,001,973 | B2 * | 5/2021 | Anderson | E01B 7/00 | |
| 2006/0065791 | A1 | 3/2006 | McCallum | | |
| 2010/0072327 | A1 * | 3/2010 | Song | A63H 19/32 | 246/415 A |
| 2010/0147183 | A1 | 6/2010 | Weissbrodt | | |
| 2016/0272226 | A1 | 9/2016 | Kulikov | | |
| 2019/0003129 | A1 | 1/2019 | Anderson et al. | | |

FOREIGN PATENT DOCUMENTS

| | | | | |
|---|---|---|---|---|
| CN | 107810135 | A | 3/2018 | |
| CN | 107858877 | A * | 3/2018 | E01B 25/12 |
| DE | 4120906 | A1 | 1/1993 | |
| DE | 19514428 | A1 | 10/1996 | |
| EP | 0153573 | A2 * | 9/1985 | |
| EP | 2354303 | A1 | 8/2011 | |
| JP | H07196041 | A | 8/1995 | |
| JP | 6525482 | B2 | 6/2019 | |
| WO | 2016126171 | A1 | 8/2016 | |

* cited by examiner

TRACK SWITCH

CROSS-REFERENCES TO RELATED APPLICATIONS

The present application is a national stage application filed under 35 U.S.C. § 371 of International Application No. PCT/US2021/014944, filed Jan. 25, 2021, which claims priority to U.S. Provisional Patent Application No. 62/965,679, filed Jan. 24, 2020, and U.S. Provisional Patent Application No. 63/041,323, filed Jun. 19, 2020. Each of the aforementioned Patent Applications is incorporated by reference in its entirety for all purposes.

STATEMENT REGARDING FEDERALLY SPONSORED RESEARCH

Not Applicable.

BACKGROUND

Railcars or trains typically travel on tracks. In some instances during travel, the railcar or train may switch from one track to another.

SUMMARY OF THE INVENTION

The present disclosure provides a track switching system and methods. In particular, systems and methods are provided for using a track switch that is designed to provide temporary or permanent railway turnouts that allow for quick, unlimited switching without the need for cutting into existing tracks. And because the track switch does not require cutting into existing track, the switch is more cost effective, does not require disruptions to the main track to install, and can be used in applications where traditional switching methods may be prohibitively expensive (e.g., as a main line turnout for industries with smaller or infrequent shipments, as stub track, to re-open industrial tracks where switches were previously removed, or for temporary access to project sites or temporary storage of train cars). When not in use, the switch may be completely separate from the main line. The design of the track switch allows for assembly in a variety configurations to suit a specific application to connect any two tracks, for example, tracks having differing vertical or horizontal geometries, longitudinal grades, side slopes, or any combination thereof.

In some aspects, the present disclosure provides a track switch that includes a turntable section, one or more track sections coupled together to form a single track, and a pair of ramp sections coupled to opposing ends of the single track. One of the track sections is rotationally coupled to the turntable section to allow ramp sections to rotate relative to the turntable section and selectively connect a first railroad track to a second railroad track.

The turntable section comprises ballast frame, a bearing base plate coupled with a pivot pin, and a bearing plate. The ballast frame further comprises two longitudinal members connected by a plurality of substantially perpendicular cross members, and is coupled with the bearing base plate, so that the pivot pin extend upwardly, away from the ballast frame. The bearing plate defines a central hole through which the pivot pin extends, thereby allowing the bearing plate to rotate about a central axis of the pivot pin.

Each of the one or more track sections further comprises a track base coupled with a track running lengthwise along the track base. The track base plates defines a hole through configured to receive the pivot pin, to provide a rotatable connection about pivot pin. The hole of the track base plate may be disposed generally in the center of the track base plate. Additionally, the track base plate is configured to fixedly couple with a connection plate at each end of the track base plate. A corresponding number of connection plates are provided to connect between each of the track sections. The one or more track sections may vary in both length and curvature.

Each of the two ramped sections comprise a ramp base plate, an angled track, at least two guard rails, and at least two rail clamps. The ramp base plate is configured to be placed on top of one of the first railroad track and the second railroad track. A pair of rail stops may be attached to the underside of the ramp base plate to align the ramp section with either the first railroad track or the second railroad track. The ramp base plate also includes ramped sections at a first distal end. Additionally, the ramp base plate is configured to fixedly couple with a connection plate at a second distal end opposite the ramped sections, wherein the connection is configured to connect between a ramp section and a track section.

The angled track slopes substantially upward from a generally pointed end adjacent the ramped sections, along the length of the ramped section, and terminating at a wide end adjacent a second distal end opposite the first distal end.

The at least two guard rails run parallel to the angled track. The at least two guard rails may be configured so that at least two guard rails are disposed to the interior of the angled track or least two guard rails are disposed to the exterior of the angled track.

The at least two rail clamps are coupled with the ramp based plate at a locking pivot and configured to provide a removable connection with an existing track. Each of the at least two rail clamps comprise a pivot bar fixedly coupled with the locking pivot, a handle configured to rotatably connect with the pivot bar, and one or more locking plates having a channel configured to receive either the first railroad track or the second railroad track. The handle and the one or more locking plates are fixedly coupled so that they rotate together about the pivot bar between and unlocked position away from the railroad track, and a locked position wherein the channels of the one or more locking plates coupled with the railroad track The track switch may further comprise one or more support frames disposed between the one or more track sections and the ground to provide support to the track sections. Each support frame comprises two longitudinal members connected by a plurality of substantially perpendicular cross members.

The track switch may further comprise an actuator system for rotating switch, for example, a hydraulic actuator. The track switch may include at least one first actuator connection bracket coupled to one of the track sections. Additionally, one or more corresponding second actuator connection brackets may be provided at the turntable section, to connect the actuator system between the track section and the turntable section. Alternatively, the one or more corresponding second actuator connection brackets may be provided on the support frame, to connect the actuator system between the track section and the support frame.

In some aspects, the present disclosure provides a method for selectively coupling a track switch to a railroad track that includes connecting a plurality of track sections together to form a single track, connecting a ramp section to each end of the single track, coupling a turntable section to one of the plurality of track sections to enable the ramp sections to rotate relative to the turntable section, and rotating the single track from a closed position where the ramp sections are misaligned with an existing track to an open positon where the ramp sections are aligned with the existing track.

The foregoing and other aspects and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims and herein for interpreting the scope of the invention.

DESCRIPTION OF DRAWINGS

The invention will be better understood and features, aspects and advantages other than those set forth above will become apparent when consideration is given to the following detailed description thereof. Such detailed description makes reference to the following drawings.

DETAILED DESCRIPTION

The invention will now be described more specifically with reference to the following non-limiting examples. It is to be noted that the following embodiments are presented herein for purpose of illustration and description only. It is not intended to be exhaustive or to be limited to the precise form disclosed.

It is to be understood that the phraseology and terminology used herein is for the purpose of description and should not be regarded as limiting. The use of "including," "comprising," or "having" and variations thereof herein is meant to encompass the items listed thereafter and equivalents thereof, as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Track switches are commonly used to allow train cars to change from one track to another, for example, to bypass a portion of a main rail line that is undergoing maintenance, to store cars on a stub track, or to act as a turnout for delivery of goods away from the main line. However, existing track switches are subject to many shortcomings. For example, installation of existing switches requires cutting into a main track, leading to long installation times, interruptions in the usability of the main track, increased maintenance, and high costs. Due to these shortcomings, traditional switching methods tend to be permanent in nature and are typically not cost effective for tracks that serve smaller industries or that are used infrequently.

Figure 1:
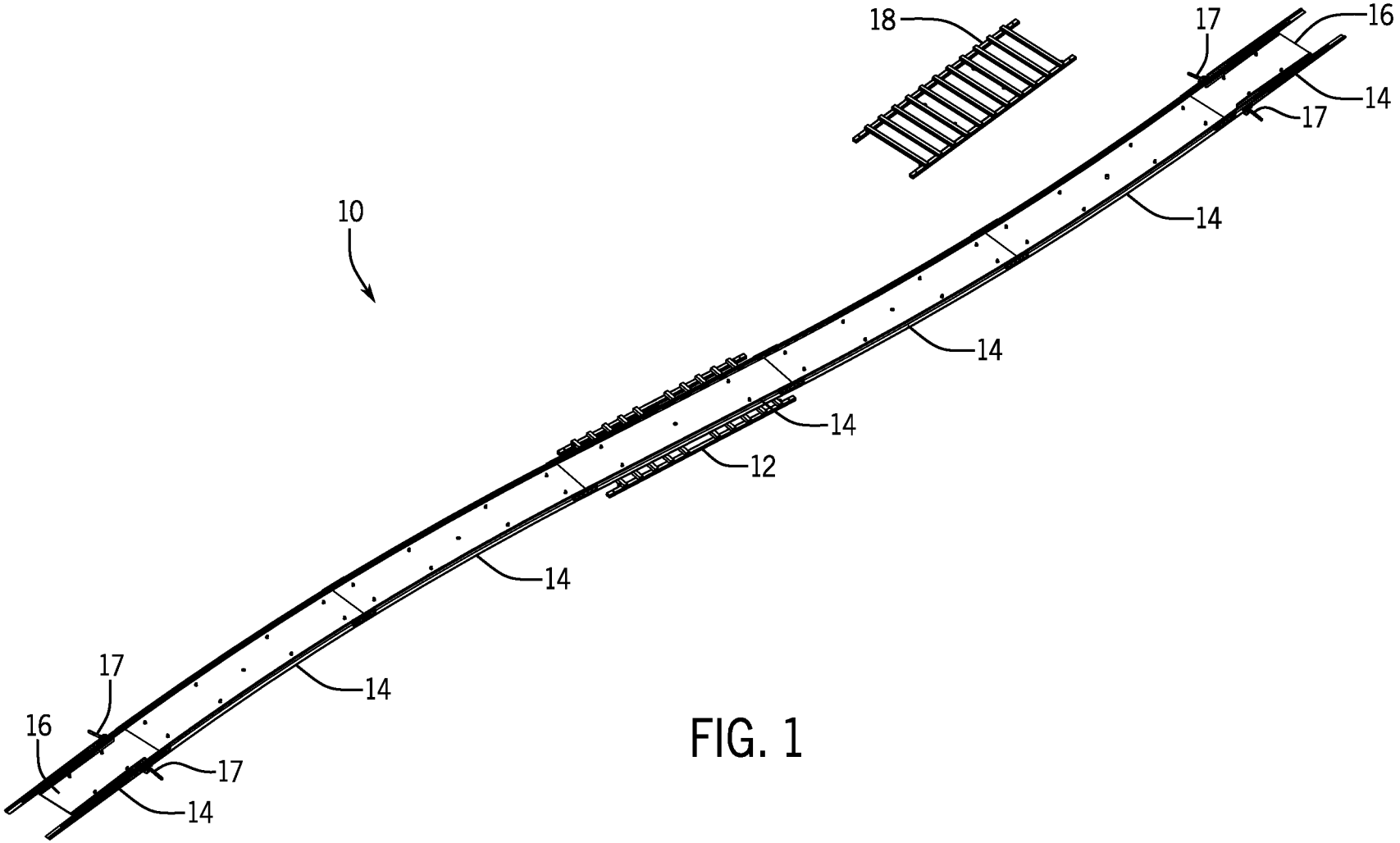
FIG. 1 is a top perspective view of a track switch, according to one aspect of the present disclosure.

FIG. 1 illustrates one non-limiting example of a track switch 10 according to aspects of the present disclosure. The track switch 10 includes a turntable section 12, one or more track sections 14 having varying lengths and curvatures, and a pair of ramp sections 16. Each of the ramp sections 16 may include a pair of laterally opposing rail clamps 17 that allow the track switch 10 to selectively couple to an existing railroad track.

The track sections 14 and the ramp sections 16 are coupled with one another to form and act as a single line of track, thereby permitting, for example, a railcar or locomotive, to travel across the track switch 10. The turntable section 12 is configured to connect with one of the track section 14, forming a rotatable connection. This connection allows the track sections 14 and the ramp sections 16 to rotate relative to the turntable section 12 between a closed position and an open position.

Additionally, a plurality of support frames 18 may be positioned generally adjacent to and/or underneath the track switch 10. The support frames 18 may provide vertical support to and a stable base for the track sections 14. The number and location of support frames 18 can vary depending on the requirements of the specific installation, including, but not limited to, soil conditions and types, drainage requirements, the length and shape of the track sections 14 being used, and the distance between the railroads that the track switch 10 is intended to connect.

Figure 2:
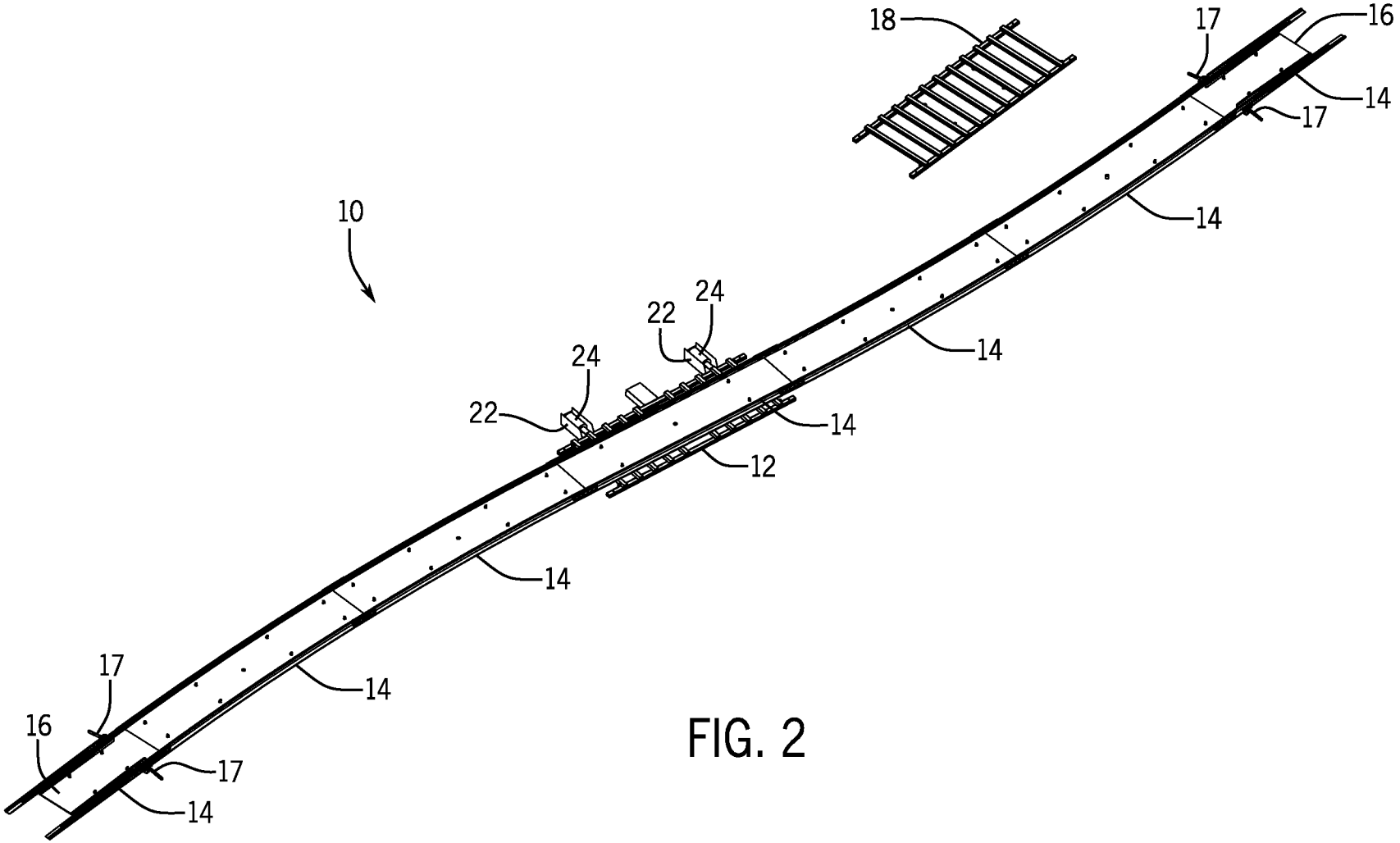
FIG. 2 is a top perspective view of another embodiment of a track switch, according to one aspect of the disclosure.

FIG. 2 shows another non-limiting example of a track switch 10, according to aspects of the present disclosure. In the illustrated non-limiting example, the track switch 10 includes actuator brackets 22 attached to the side of the turntable section 12. The actuators 24 (e.g., hydraulic actuators) may be connected between the actuator brackets 22 and one of the track sections 14. Specifically, the actuators 24 may be coupled between the turntable section 12 and the track section 14 that is coupled to the turntable section 12. In this way, for example, the actuators 24 are configured to selectively rotate the track switch 10 between an open position and a closed position. In the illustrated non-limiting example, the actuators 24 are arranged on a common side of the turntable section 12. In other non-limiting examples, the actuators 24 may be arranged on laterally opposing sides of the turntable section 12 (see FIG. 4). In the illustrated non-limiting example, one of the actuators 24 may push (e.g., extend) the track section 14 coupled thereto and the other actuator 24 may pull (e.g., retract) the track section 14 during rotation of the track switch 10.

Figure 3:
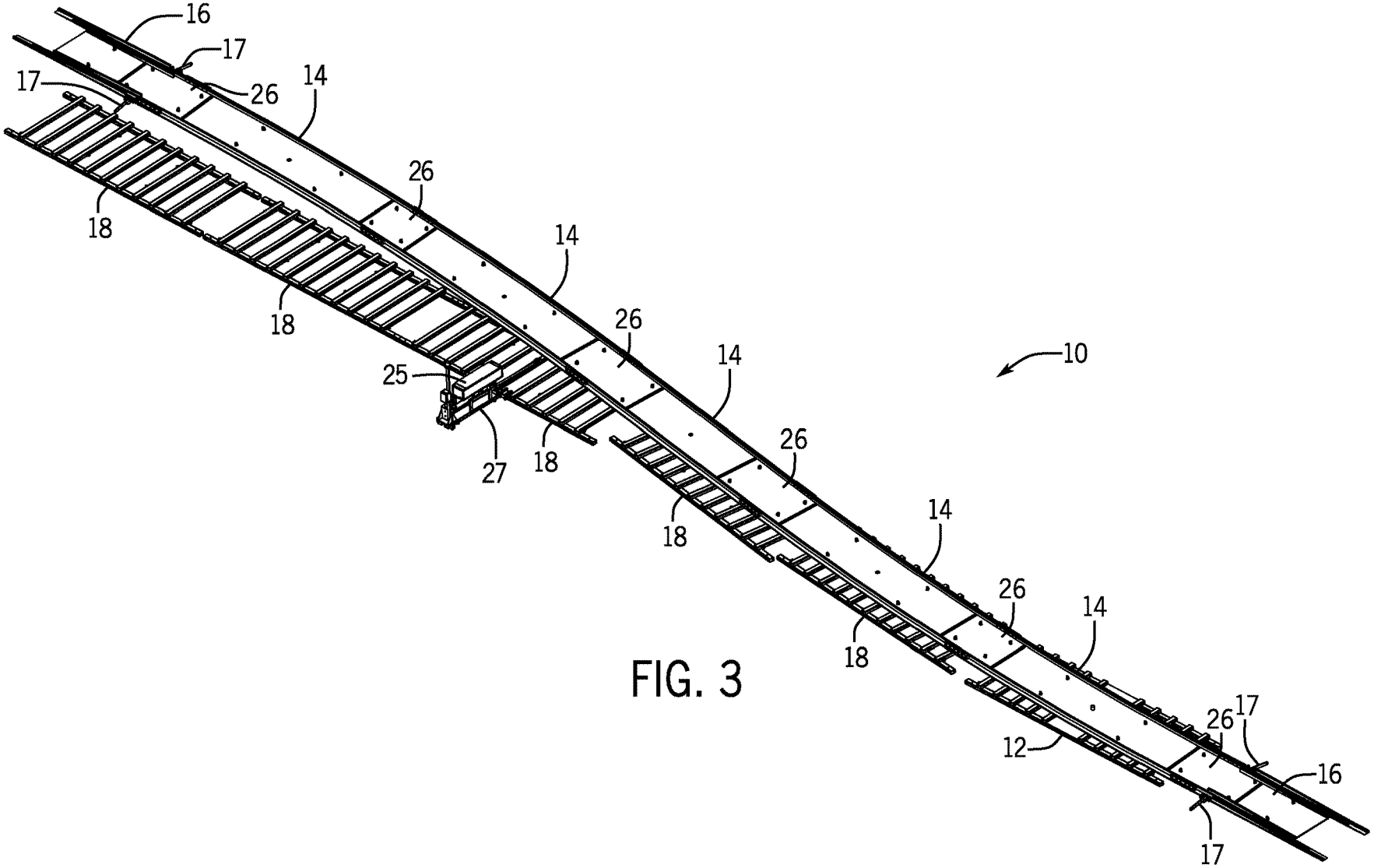
FIG. 3 is a top perspective view of another embodiment of a track switch, according to one aspect of the disclosure.

FIG. 3 shows another non-limiting example of a track switch 10, according to aspects of the present disclosure. In the illustrated non-limiting example, the track switch 10 includes a track connection bracket 26 at each intersection between the track sections 14 and between the track section 14 and the ramp sections 16. The track connection brackets 26 may be configured to securely couple the track sections 14 and the ramp sections 16 together to form a single track. In other non-limiting examples, the track sections 14 and the ramp sections 16 may be coupled to one anther via interlocking features present on the sections themselves.

In the illustrated non-limiting example, an actuator bracket 27 is coupled to one of the support frames 18. The actuator bracket 27 houses an actuator 25 that may be coupled to one of the track sections 14. Arranged in this manner, the track switch 10 can be rotated about the turntable section 12, between a closed portion and an open position, by extend or retracting the actuator 25.

In general, the various component of the track switch 10 may be customized to suite a particular railroad application. For example, the arrangement of the turntable section 12 may be varied along the track switch 10 to alter the location of a pivot point defined by the track switch. For example, in some non-limiting examples, the turntable section 12 may be arranged generally adjacent to a longitudinal middle of the track switch (see, e.g., FIGS. 1, 2, 4, 5). Alternatively, the turntable section 12 may be arranged generally adjacent to one end (see, e.g., FIGS. 3, 6, 7) of the track switch (e.g., adjacent to one of the ramp sections 16). One or more actuators may be coupled to a corresponding number of the track sections to enable rotation of the track switch 10, as long as the actuator is arranged a distance away from the pivot point. It should be appreciated that in some non-limiting examples, the track switch 10 may be rotated by an external component not directly coupled to the track switch. That is, the track switch 10 may not include an actuator coupled to a track section (see, e.g., FIG. 1), and the track switch 10 may be selectively rotated by an external device (e.g., an off-highway vehicle or forklift).

Figure 4:
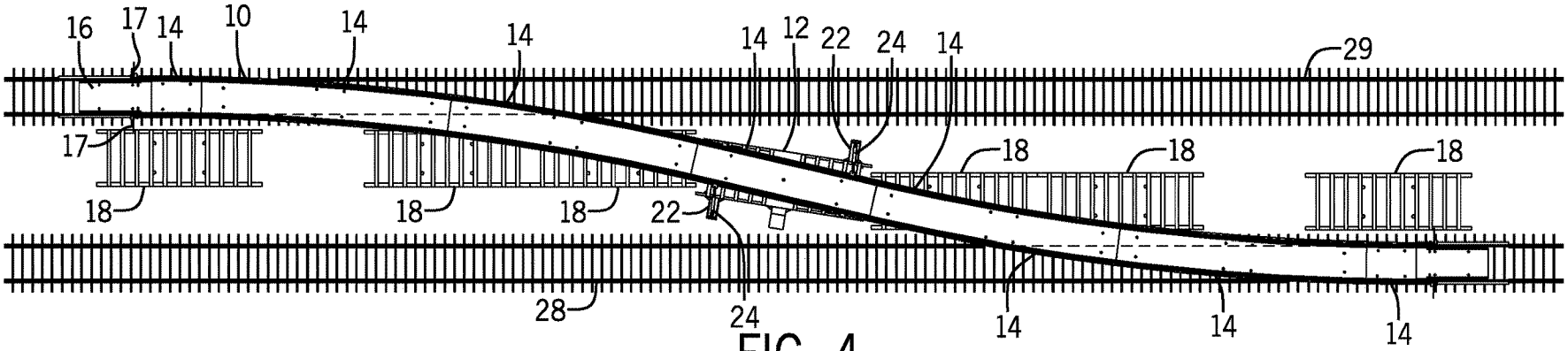
FIG. 4 is a top view of another embodiment of a track switch in an open position, according to one aspect of the disclosure.

FIG. 4 shows another non-limiting example of a track switch 10 in an open position, according to aspects of the present disclosure. In the illustrated non-limiting example, the turntable section 12 includes two actuators 24 coupled to laterally opposing sides thereof. In this non-limiting example, both of the actuators 24 may extend to rotate the track switch 10 from a closed position (see FIG. 5) to the open position (FIG. 4), or both of the actuators 24 may retract to rotate the track switch 10 from the open position (FIG. 4) to the closed position (FIG. 5).

In the open position, the track switch 10 is rotated such that the ramp sections 16 are aligned with and provide a path between a first existing track 28 and a second existing track 29. That is, the ramp sections 16 may be rotated to the open position where the ramp sections 16 align with the first existing track 28 and the second existing track 29. With one of the ramp sections 16 aligned with the first existing track 28 and the other ramp section 16 being aligned with the second existing track 29, a railcar or locomotive is able to travel along the first existing track 28, across the track switch 10, and onto the second existing track 29, or visa versa. In doing so, the railcar or train will travel onto a ramp section 16, across the various track sections 14, and finally off the other ramp section 16. Additionally, when in the open position, each of the rail clamps 17 is coupled to the respective one of the first existing track 28 and the second existing track 29, thereby preventing the track switch 10 from rotating out of the open position.

Figure 5:
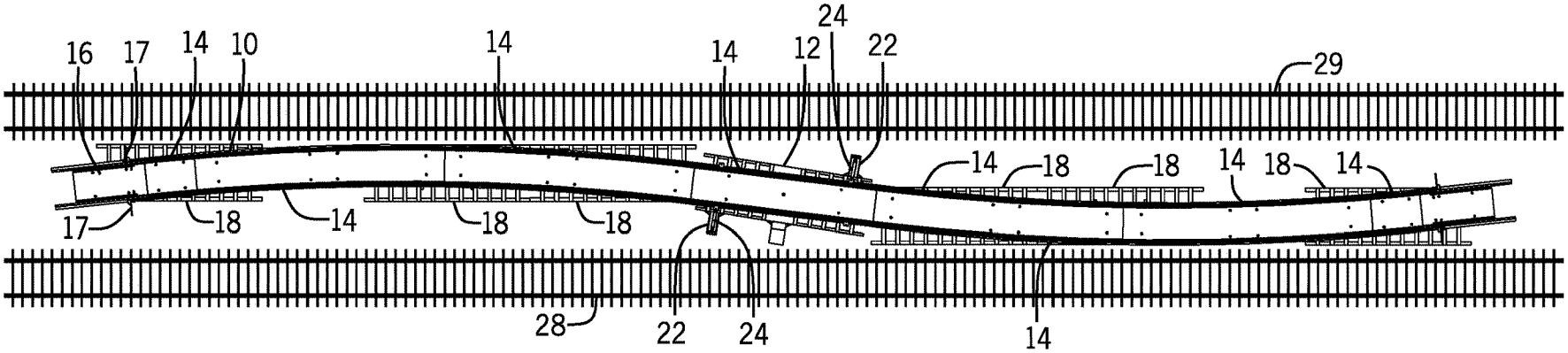
FIG. 5 is a top view of the track switch of FIG. 4 in a closed position.

FIG. 5 shows the track switch 10 of FIG. 4 in a closed position. In the closed position, each of the rail clamps 17 is disengaged from the first existing track 28 and the second existing track 29. With the rail clamps 17 disengaged, the track switch 10, and the ramps sections 16, can be rotated away from both of the first existing track 28 and the second existing track 29, so that the ramp sections 16 are not in alignment and do not overlap with the first existing track 28 and the second existing track 29. Due to the misalignment and non-overlapping arrangement between the ramp sections 16 and the first existing track 28 and the second existing track 29, a railcar or locomotive, or other object traveling down the railway, would be unable to traverse across the track switch 10. That is, the track switch 10 does not alter the travel along the first existing track 28 and the second existing track 29 in the closed position. As such, a railcar or locomotive to travel on the first existing railroad track 28 or the second existing track 29 would be able to continue down the respective track uninhibited.

With regard to both FIG. 4 and FIG. 5, it is preferable that an adequate number of support frames 18 are used, and arranged in such a manner, so as to ensure all of the track sections 14 and the ramp sections 16 are supported. For example, one or more support frames 18 may be arranged between the first track section 28 and the second track section 29 to provide support for the track sections 14 that are not supported by the turntable section 12, and for the ramp sections 16 when the track switch is in the closed position.

Figure 6:
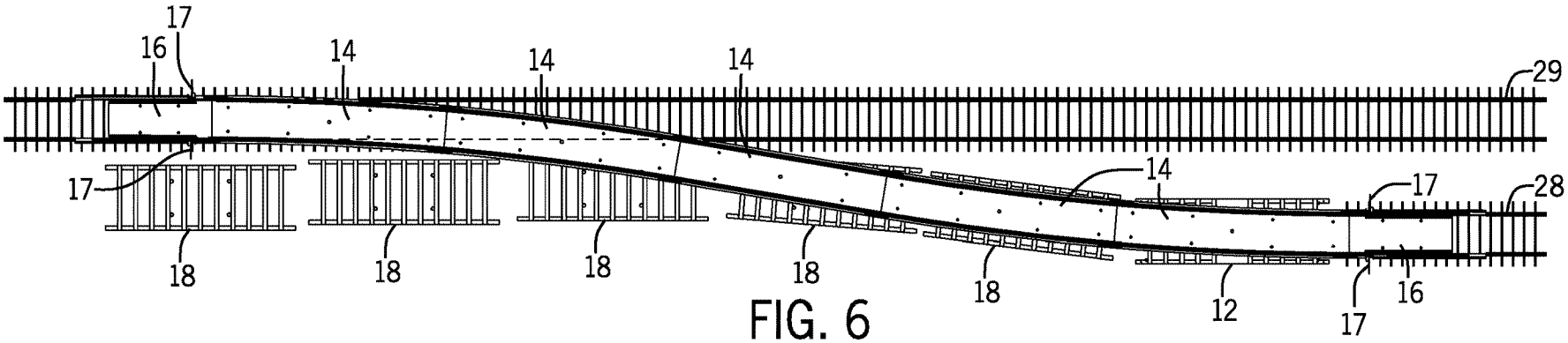
FIG. 6 is a top view of another embodiment of a track switch in an open position, according to one aspect of the disclosure.

FIG. 6 shows another track switch 10, in an open position, according to aspects of the present disclosure. In the open position, the track switch 10, and the ramp sections 16, is rotated such that the ramp sections 16 are aligned with and rest upon the first existing track 28 and the second existing track 29. With one of the ramp sections 16 aligned with the first existing track 28 and the other ramp section 16 being aligned with the second existing track 29, a railcar or locomotive is able to travel along the first existing track 28, across the track switch 10, and onto the second existing track 29, or visa versa. In doing so the railcar or train will travel onto a ramp section 16, across the various track sections 14, and finally off the other ramp section 16. Additionally, when in the open position, each of the rail clamps 17 is coupled to the respective track 28, thereby preventing the track switch 10 from rotating out of the open position.

Figure 7:
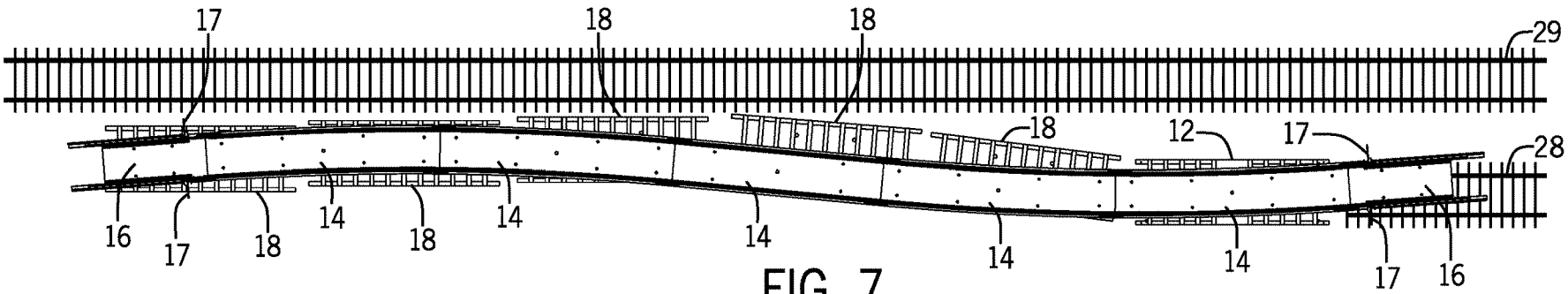
FIG. 7 is a top view of the track switch of FIG. 6 in an closed position.

In the illustrated non-limiting example, the pivot point defined be the position of the turntable section 12 along the track switch 10 is arranged adjacent to one of the ramp sections 16 (e.g., the right ramp section 16 from the perspective of FIGS. 6 and 7). The track switch 10, and the ramp sections 16, may be rotated between the open position and a closed position (FIG. 7) by an external device that is configured to provide a force on one of the track section 14 and rotate the ramp sections 16 about the pivot point in the turntable section 16. Alternatively or additionally, the track switch may include one or more actuators as described herein to selectively rotate the ramp sections 16 between the open position and the closed position.

FIG. 7 shows the example track switch 10 of FIG. 6 in a closed position. In the closed position, each of the rail clamps 17 is disengaged from the first existing track 28 and the second existing track 29. With the rail clamps 17 disengaged, the track switch 10, and the ramps sections 16, can be rotated away from one or more of the first existing track 28 and the second existing track 29, so that the ramp sections 16 are not in alignment and do not overlap with the first existing track 28 and/or the second existing track 29. Due to the misalignment and non-overlapping arrangement between the ramp sections 16 and the first existing track 28 and/or the second existing track 29, a railcar or locomotive, or other object traveling down the railway, would be unable to traverse across the track switch 10.

In this specific non-limiting example, the track switch 10 is entirely separated from only the second existing track 29, with one of the ramp sections 16 remaining in an overlapped but misaligned arrangement with the first existing track 28. As such, a railcar or locomotive would be able to travel on the second existing track 29 when the track switch is in the closed position.

Figure 8:
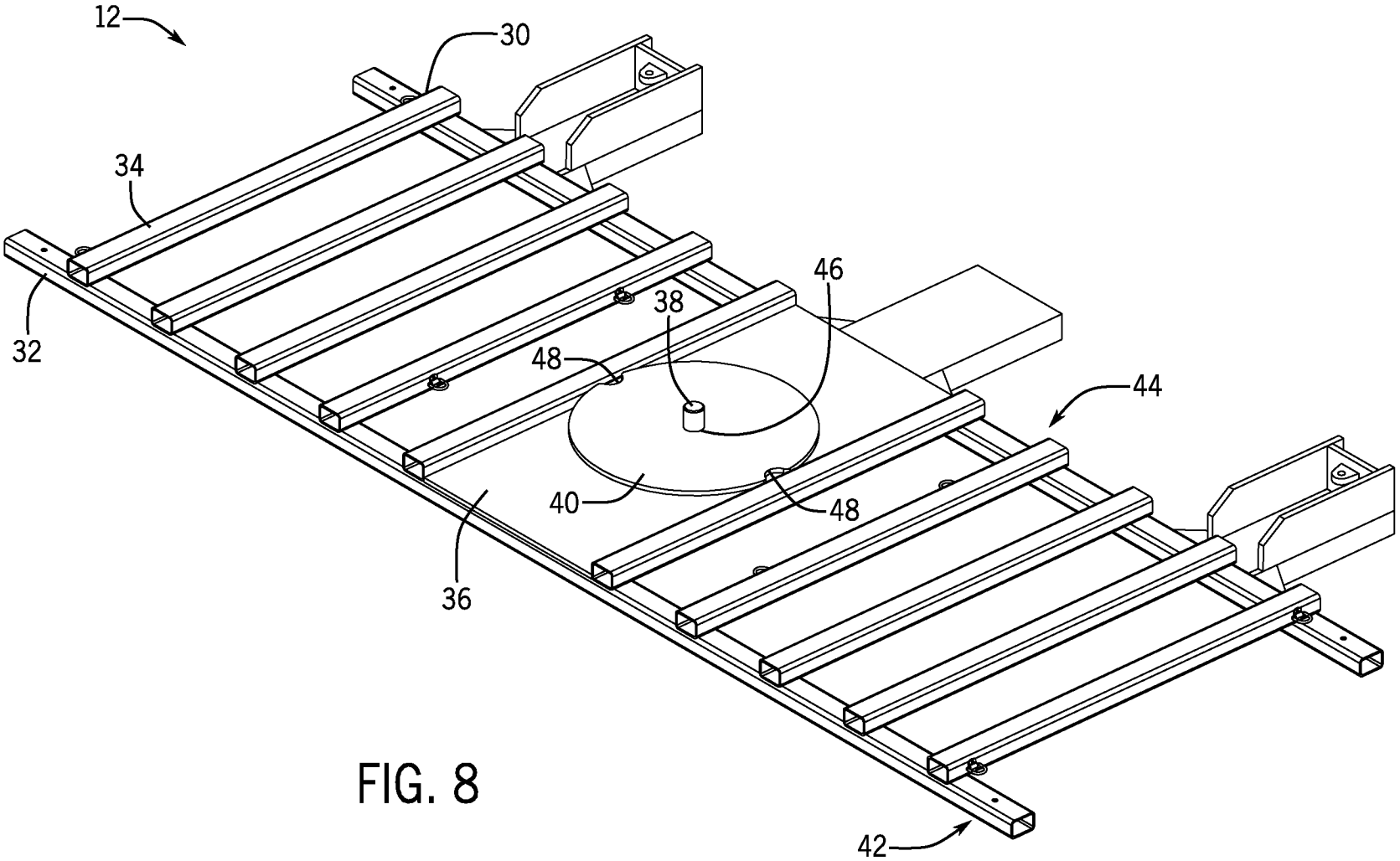
FIG. 8 is a perspective view of a turntable section, according to one aspect of the disclosure.
Figure 9:
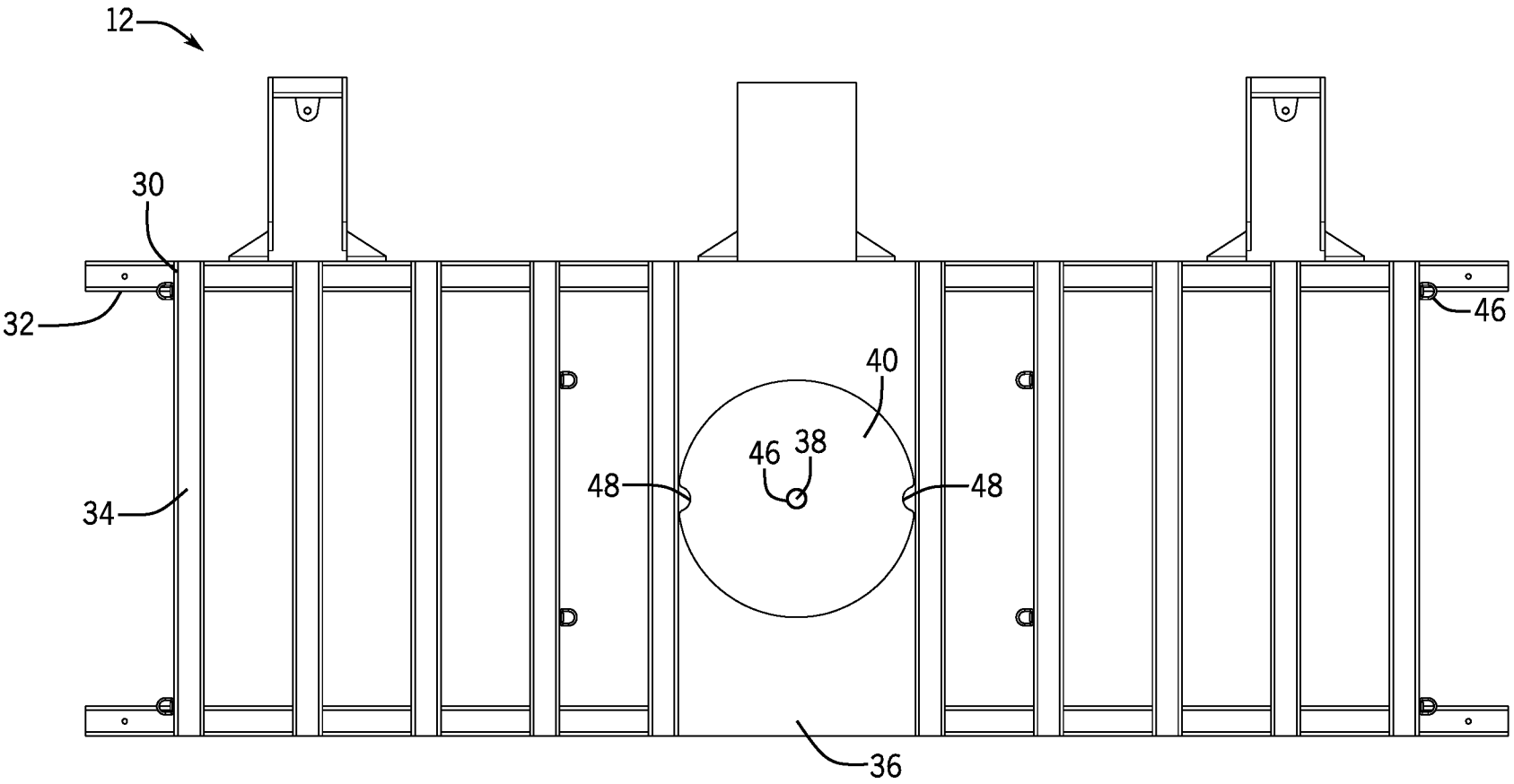
FIG. 9 is a top view of the turntable section of FIG. 8.

FIGS. 8 and 9 illustrate an example turntable section 12, according to aspects of the disclosure. The turntable section 12 includes a ballast frame 30 having at least two longitudinal members 32 connected by a plurality of cross members 34, a bearing base plate 36, a pivot pin 38, and a bearing plate 40. Depending on the desired configuration, the bearing base plate 36 may include one or more individual plates.

The ballast frame 30 defines a bottom portion 42 configured to rest on the ground, and a top portion 44 configured to connect with and support the bearing base plate 36. Additionally, the ballast frame 30 may include various attachment or lifting points 46 for moving, transporting, or installing the turntable section 12.

The pivot pin 38 is coupled with and extends upwardly from bearing base plate 36. The bearing plate 40 defines a hole 46 which receives the pivot pin 38, forming a rotatable connection that allows the bearing plate 40 to rotate relative to the bearing base plate 36 and the ballast frame 30. The bearing plate 40 may come in various shapes, however is it preferably circular and may include a number of indented portions 48 on the outer circumference. The indented portions 48 may be used, for example, to aid in locating the track switch 10 in an open or a closed position. The bearing plate 40 is supported by the bearing base plate 36.

The turntable section also includes the actuator brackets 22 attached to the ballast frame 30. Here, two actuator brackets 22 are coupled to the same longitudinal member 32 on one side of the frame 30. However, the number and position of the actuator brackets 22 can vary depending on the configuration of the track switch 10 being used. For example, in some cases there may be no actuator bracket 22, or there may only be one. Further, where multiple brackets 22 are used, the brackets 22 do not need to be located on the same side of the ballast frame 30, and may be located on different longitudinal members 32, so that the brackets 22 are disposed on opposite sides of the ballast frame 30.

Figure 10:
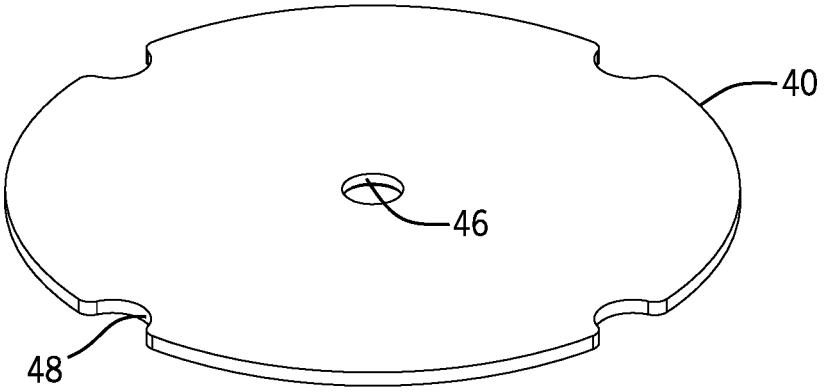
FIG. 10 is a perspective view of a bearing plate, according to one aspect of the disclosure.
Figure 11:
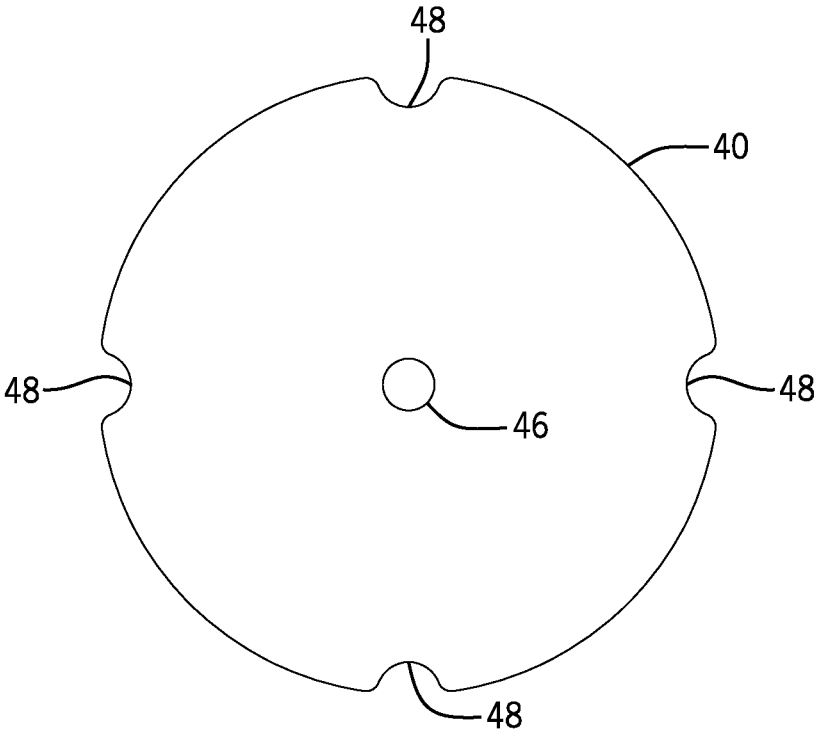
FIG. 11 is a top view of the bearing plate of FIG. 10.

FIGS. 10 and 11 show an example bearing plate 40, according to aspects of the disclosure. The bearing plate 40 is generally circular in shape and includes a central hole 46 configured to receive the pivot pin 38 of the turntable section 12. A rotatable connection is formed by inserting the pivot pin 38 in the hole 46, which permits the bearing plate 40 to rotate around the pivot pin 38. When the pivot pin 38 is received by the hole 46, the bearing plate 40 is disposed adjacent to the bearing base plate 36. It should be noted that oils, greases or other lubricants may be placed between the bearing plate 40 and the bearing base plate 36 to reduce friction as the bearing plate 40 rotates.

The bearing plate 40 may also include various indented portion 48, disposed around the outer perimeter of the bearing plate 40. In this case, there are four indented portions 48, however there may be more or less. Furthermore, while the indented portions 48 shown here are semicircular in shape, the indented portions 48 may take on a variety of shapes depending on what is required by the application.

It should be understood and appreciated, as will become apparent in the present disclosure, that the track sections 14 do need not be a single length or shape. Rather, some track sections 14 may be considered long, and others comparatively short. Furthermore, some track sections 14 may be straight, while others may be curved. The number, length, and curvature of the track sections 14 used will be determined by the specific application of the track switch 10 and the existing track sections being selectively connected by the track switch 10.

Figure 13:
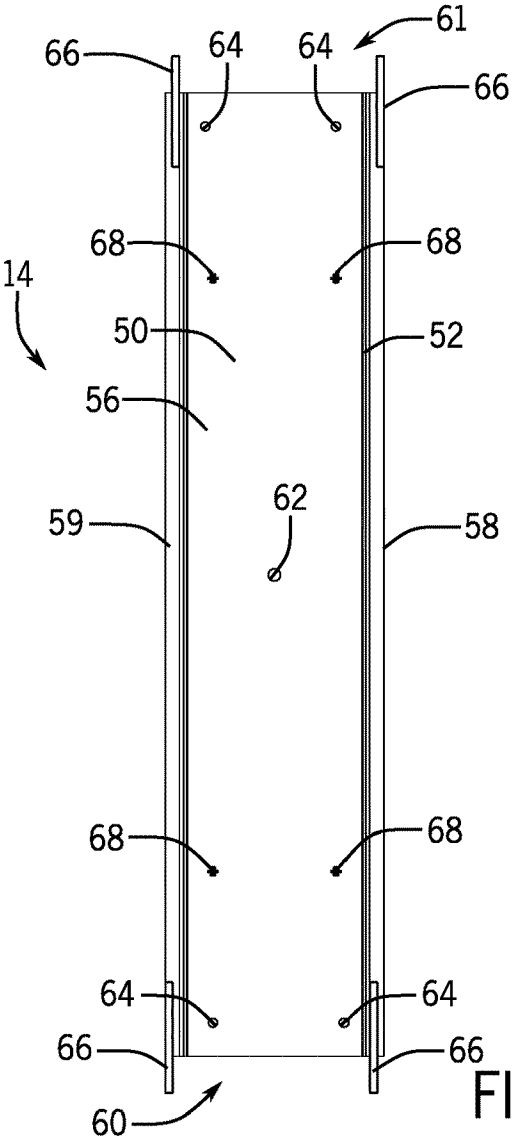
FIG. 13 is a top view of the track section of FIG. 12.
Figure 12:
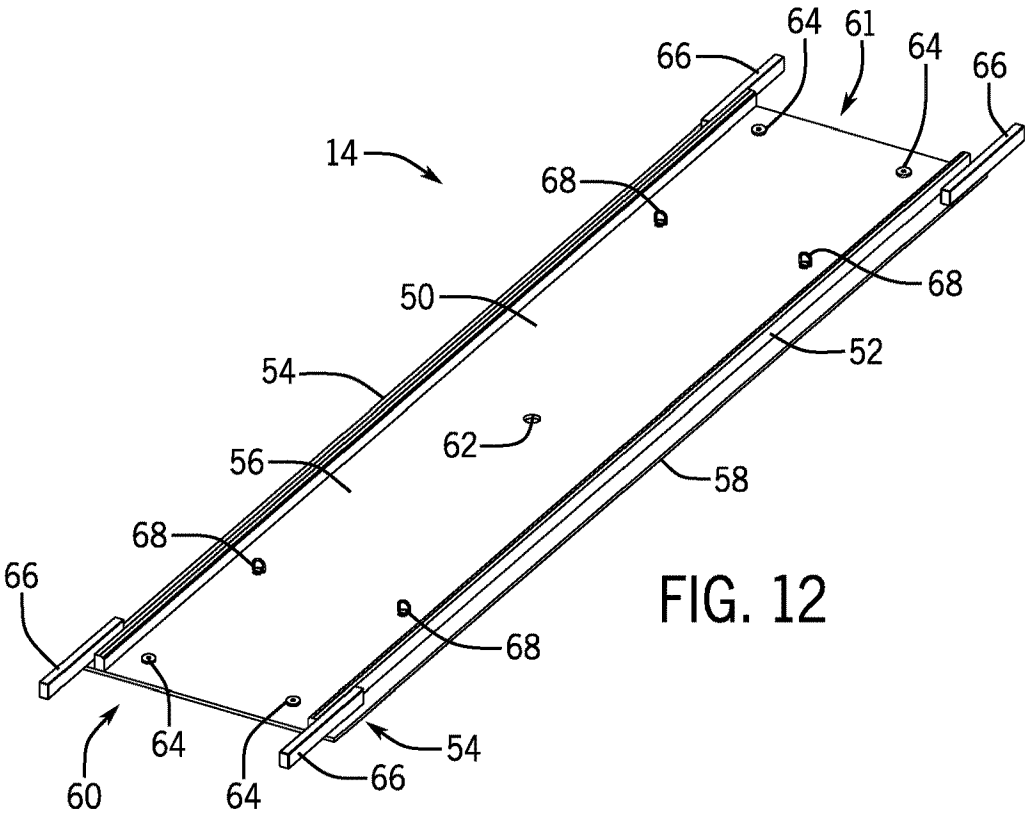
FIG. 12 is a perspective view of a track section, according to one aspect of the disclosure.

Referring to FIGS. 12 and 13, an example track section 14 is shown according to aspects of the disclosure. The track section 14 includes a track base plate 50 and a track 52. The track base plate 50 defines a bottom surface 54, a top surface 56, two sides 58 and 59, and a first distal end 60 and a second distal end 61. The track base plate 50 is a generally longitudinal flat plate, having a hole 62 extending through the track base plate 50.

The hole 62 is configured to receive the pivot pin 38 of the turntable section 12, establishing a rotatable connection between the track section 14 and the turntable section 12 about the pivot pin 38. When the hole 62 of the track base plate 50 receives the pivot pin 38, the bottom surface 54 of the track base plate 50 is disposed adjacent to the bearing plate 40 of the turntable section 12. While multiple track sections 14 that are capable of receiving a pivot pin 38 may be used, only one of the track sections 14 receives the pivot pin 38. Thus, the track sections 14 in a given assembly of the track switch 10 may be assembled in a modular fashioned and the pivot point may be determined by the position of the turntable section 12 and the particular track section 14 that receives the pivot pin 38. In some non-limiting examples, some of the track sections 14 may include a hole 62, and others may not, as long as one of the track sections 14 is capable of receiving the pivot pin 38.

While the hole 62 is shown here to be disposed generally in the center of the track base plate 50, the hole 62 may be placed anywhere on the track base plate 50. By having the hole 62 located for example, near distal end 60, the center of rotation of the track switch 10 can be adjusted to fit a specific application of the track switch 10.

The track 52 is configured to allow, for example, a railcar or locomotive, to travel along the track 52. The track 52 is fixedly connected to the top surface 56 of the track base plate 50 and runs along the length of the track base plate 50 from one distal end 60 of the track base plate to second distal end 61 of the track base plate 50.

The distal ends 60 and 61 of the track base plate 50 are each configured to connect and align with a distal end 60 or 61 of another track base plate 50 or a ramp section 16. As shown here, threaded holes 64 are disposed in the track base plate 50, adjacent to each distal end 60 and 61 of the track base plate 50. The threaded holes 64 may be configured to align with corresponding holes 65 of the track connection bracket 26 (see FIG. 17). When the holes 64 are aligned with the holes 65 of the track connection bracket 26, the track section 14 can be coupled with another track section 14 via track connection bracket 26 and plurality of fasteners. However, other means of connecting track sections 14 may be utilized, for example, connecting with fasteners only, or by welding abutting track sections 14 together, or by having interlocking connectors configured to connect the tracks without the use of additional hardware.

Additionally, the track section 50 may include offset alignment bars 66, which are configured to help align abutting track sections 50, so that the respective tracks 52 are in linear alignment with one another. In some non-limiting examples, the track section 14 may include a plurality of attachment or lifting points 68 for moving, transporting, or installing the track section 14

Figure 14:
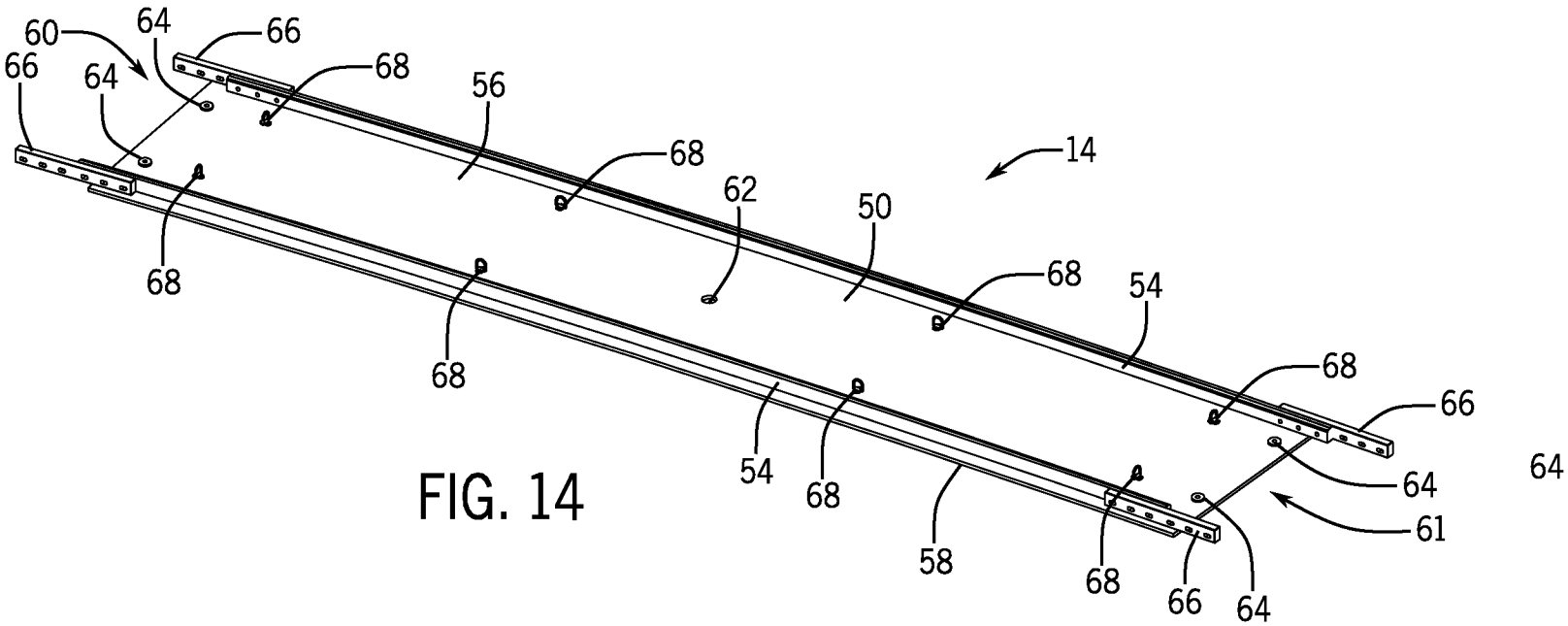
FIG. 14 is a perspective view of another embodiment of a track section, according to one aspect of the disclosure.
Figure 15:
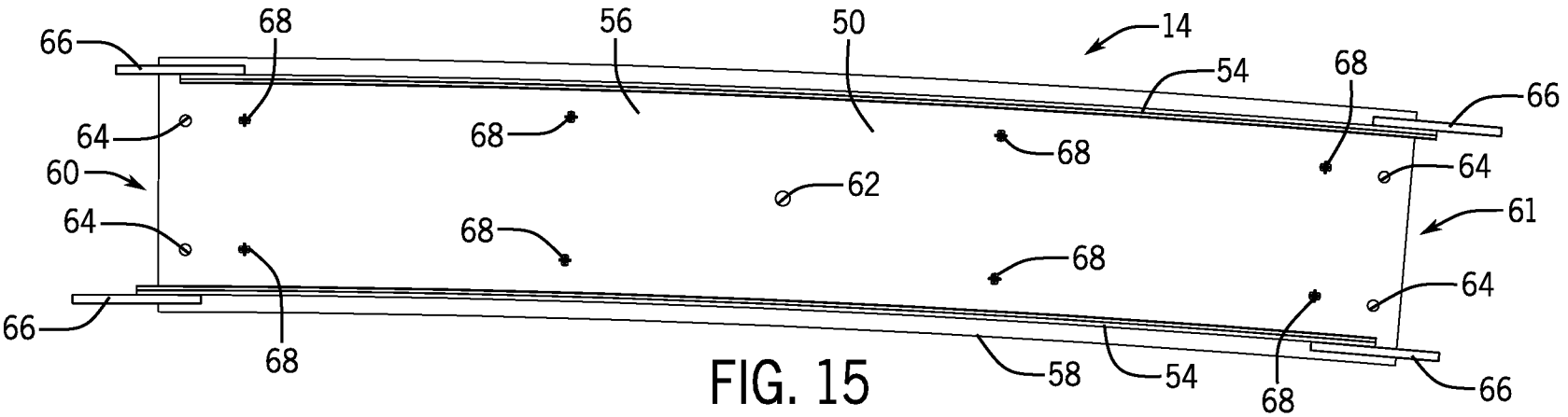
FIG. 15 is a top view of the track section of FIG. 14.

Referring to FIGS. 14 and 15, another example track section 14 is shown according to aspects of the disclosure. In the present embodiment, track section 14 is curved longitudinal member. The tracks 52 are configured to have a curvature which corresponds to the curvature of the track base plate 50. The curvature of the track section 14 can vary as needed to allow the track switch 10 to connect to a variety of existing railroad tracks 28.

In general, the track sections 14 may vary in length and curvature, as illustrated herein, to provide a single track that extends between the ramp sections 16. As such, the track sections 14 may be customized to fit a particular existing track arrangement and/or a particular distance between existing tracks.

Figure 16:
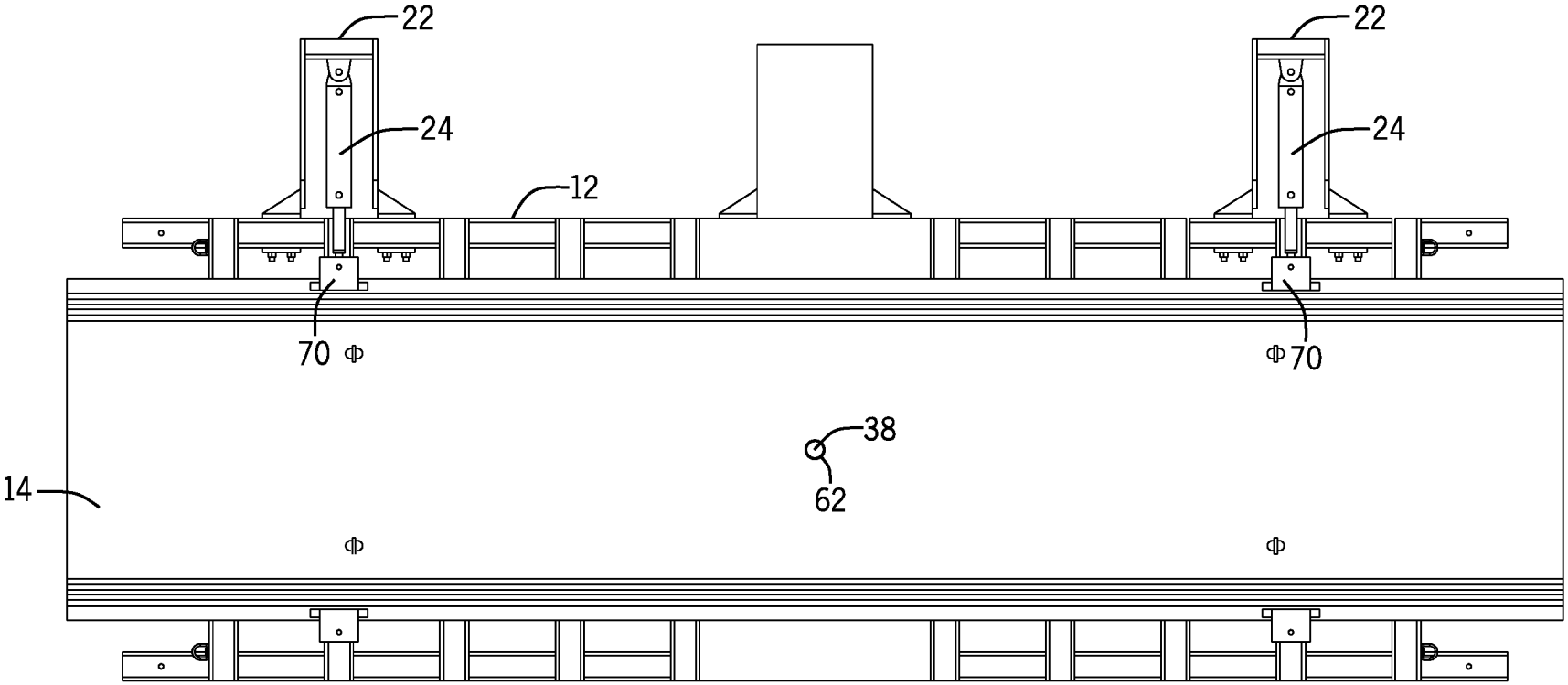
FIG. 16 is a top view of a track section connected to a turntable section.

FIG. 16 shows an example track section 14 that is coupled to the turntable section 12. In the illustrated non-limiting example, the pivot pin 38 is received by the hole 62 in the track section 14. The actuators 24 are coupled with both the actuator brackets 22 and the track section 14. The track section 14 is coupled to the actuators 24 at brackets 70. In this arrangement, the actuators 24 are configured to extend and retract to enable rotation of the track section 14, and thereby rotation of the ramp sections 16 between the open position and the closed position.

Figure 17:
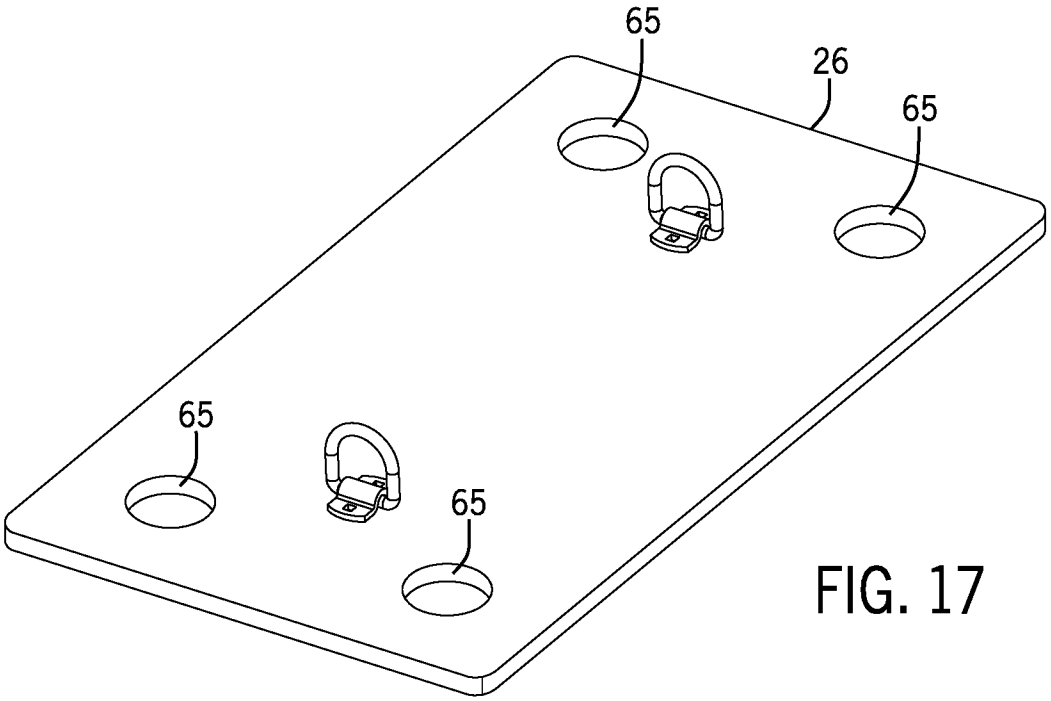
FIG. 17 is a perspective view of a track connection bracket, according to one aspect of the disclosure.
Figure 18:
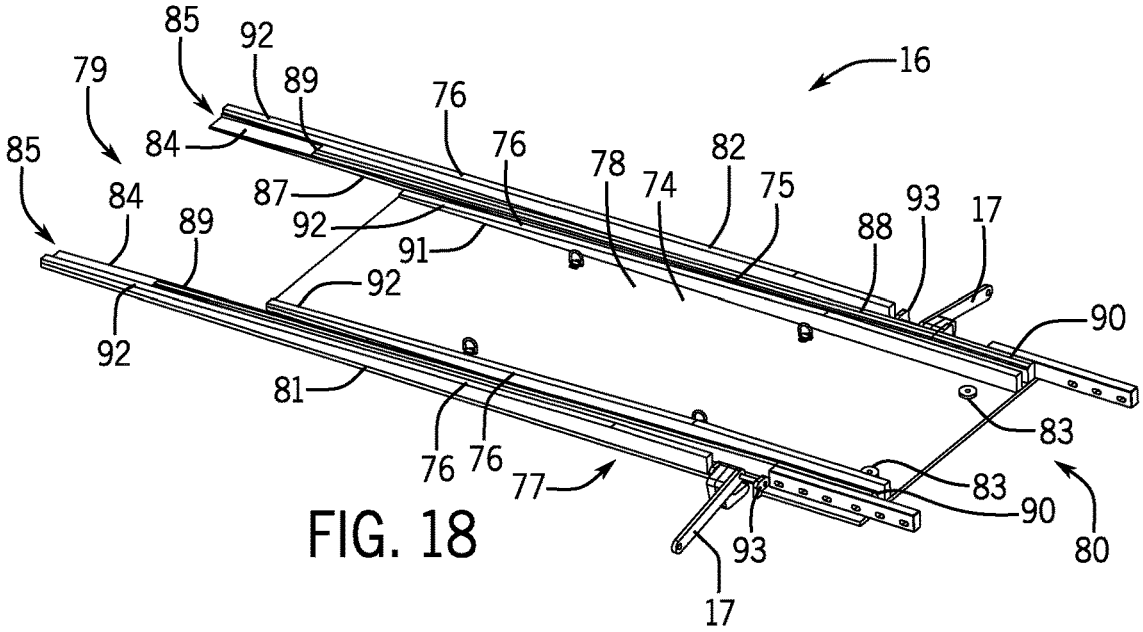
FIG. 18 is a perspective view of a ramp section, according to one aspect of the disclosure.
Figure 19:
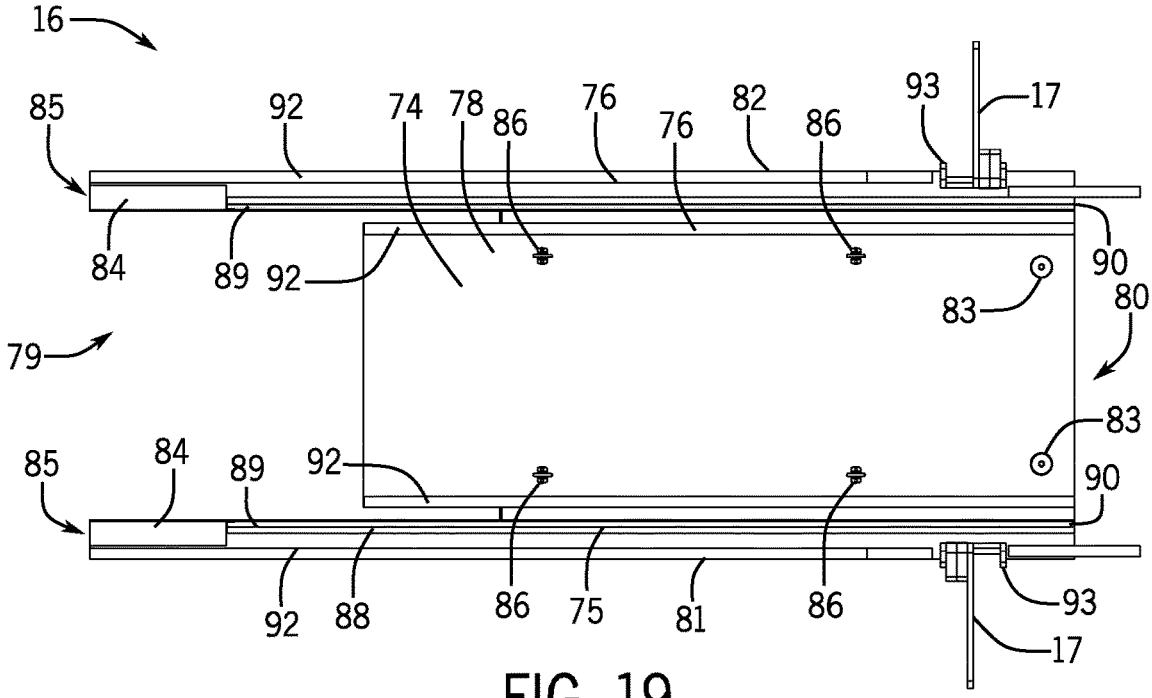
FIG. 19 is a top view of the ramp section of FIG. 18.
Figure 20:
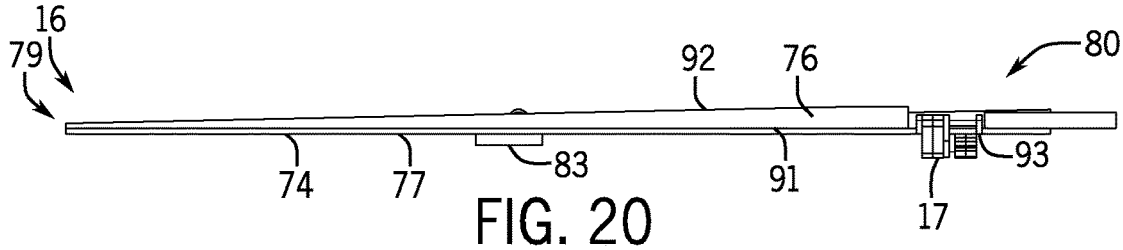
FIG. 20 is a side view of the ramp section of FIG. 18.

FIG. 17 shows an example track connection bracket 26, according to aspects of the disclosure. The track connection bracket 26 defines holes 65 that correspond to holes 64 of the track section 14. When the holes 65 are aligned with the holes 64 of the track section 14, a fastener can be inserted into the respective holes 64 and 65 to couple the track connection bracket 26 with two track sections 14, or to couple a track section 14 to a ramp section 16 (see FIG. 3).

FIGS. 18-25 show an example ramp section 16 according to aspects of the disclosure. The ramp section 16 is comprised of a ramp base plate 74, a ramped track 75, guard rails 76, and a pair of rail clamps 17. The ramp base plate 74 includes a bottom face 77 configured to rest atop a railroad track 28, a top face 78, a first distal end 79, a second distal end 80 each configured to connect with a track section 14, and two sides 81 and 82 (see FIG. 21-22). The bottom face 77 of the ramp base plate 74 may also include ramp stops 83 attached to the bottom face 77 to assist in aligning the ramp section 16 on the railroad track 28.

Figure 21:
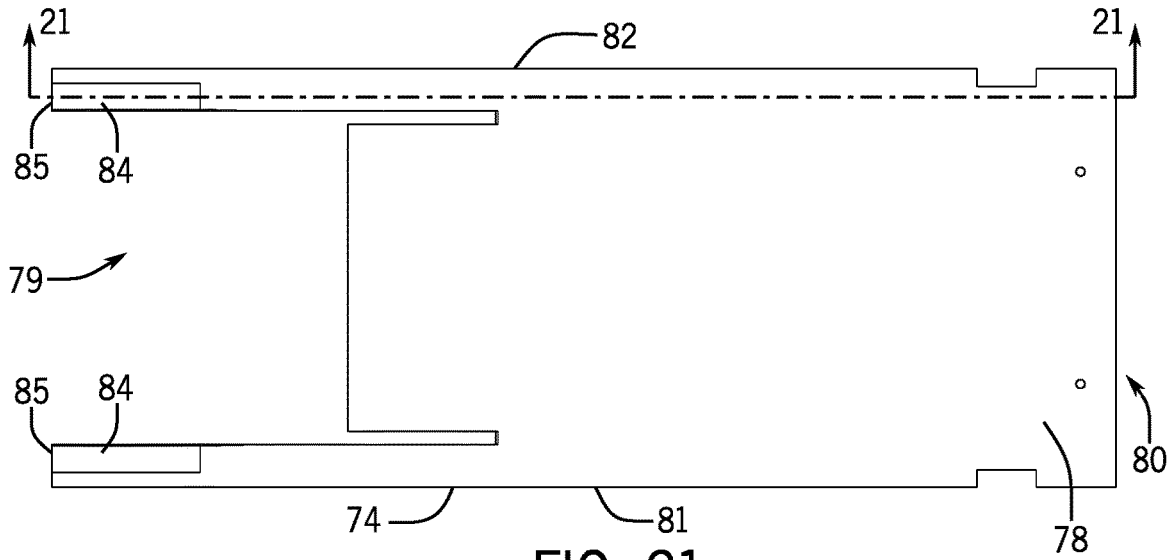
FIG. 21 is a top view of a ramp base plate of the ramp section of FIG. 18.
Figure 22:
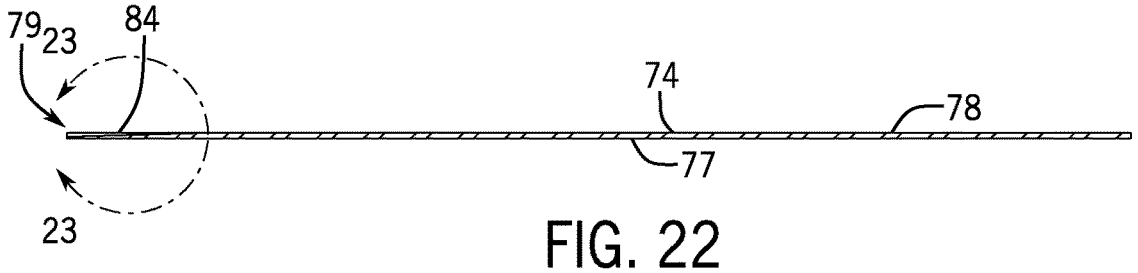
FIG. 22 is a cross-sectional view taken along 21-21 in FIG. 21
Figure 23:
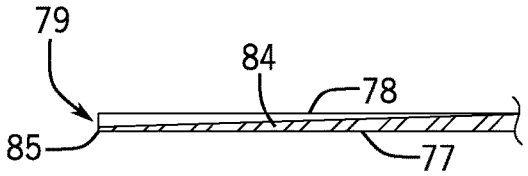
FIG. 23 is an enlarged view of portion 23-23 in the cross-sectional view shown in FIG. 22.

Referring specifically to FIGS. 21-23, the ramp base plate 74 further defines a ramped portion 84 at the first distal end 79 that extends from a substantially pointed region 85 nearest the first distal end 79 and the bottom face 77. The ramped portion 84 slopes upwardly at an angle to the top face 78, in the direction of the second distal end 80. The top face 78 of the ramp base plate 74 may be coupled to lifting points 86 to aid in moving the ramp section 16 during transport or installation.

Figure 24:
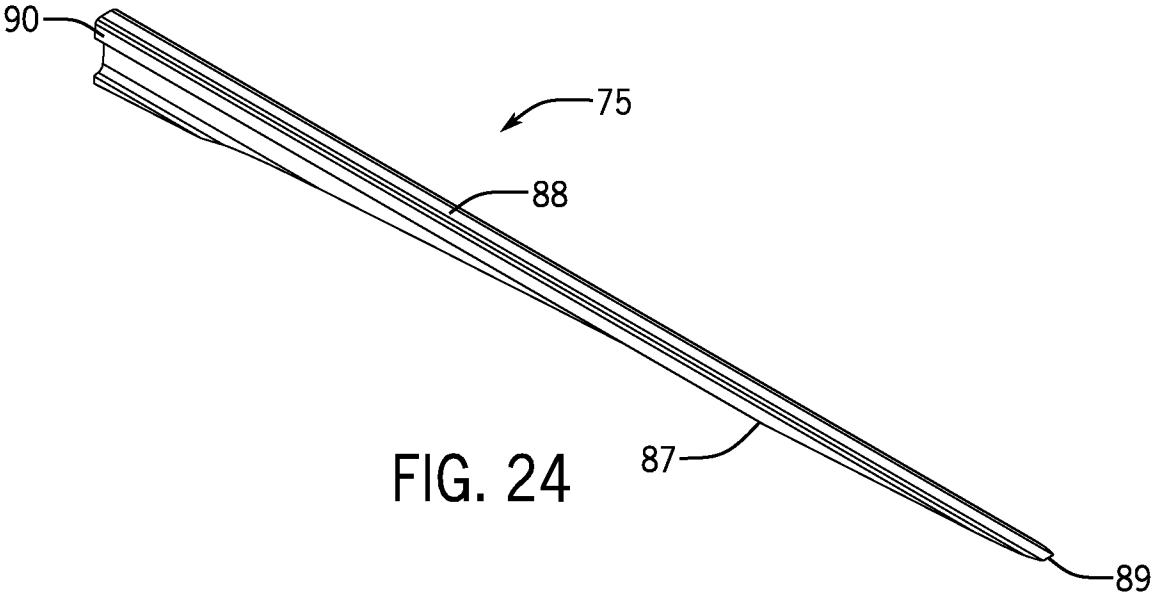
FIG. 24 is a partial top perspective view of a ramped track of the ramp section of FIG. 18.
Figure 25:
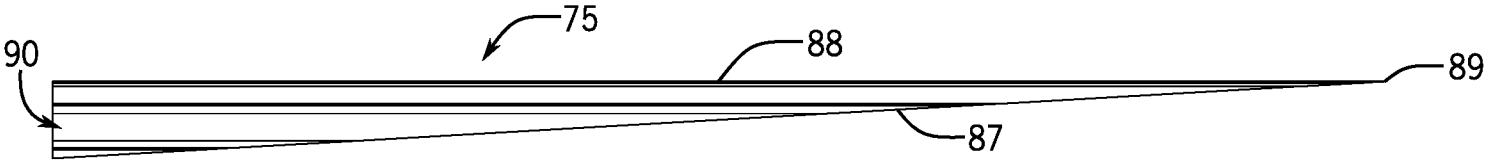
FIG. 25 is a side view of a ramped rail of the ramp section of FIG. 18.

The ramped track 75 is comprised of two parallel ramped rails, each defining a bottom surface 87 and a sloped top surface 88 which forms a generally pointed end 89, and a wide end 90 (see FIGS. 24 and 25). The angle of the sloped top surface 88 corresponds with the angle of the ramped portion 84 of the ramp base plate 74. The ramped track 75 is coupled with the ramp base plate 74, so that the bottom surface 87 of the ramped track 75 is in contact with the top surface 78 of the ramp base plate 74.

The ramped track 75 is oriented such that the pointed ends 89 of the ramped track 75 are disposed adjacent to the ramped portion 84 of the ramp base plate 74. The ramped track 75 extends along the length of the ramp base plate 74 toward the second distal end 80 of the ramp base plate 74. Oriented in this manner, the ramped portion 84 of the ramp base plate 74 and the sloped top surface 88 of the ramped track 75 form a generally continuous upward slope, beginning at the first distal end 79 of the ramp base plate 74 and terminating at the second distal end 80.

The guard rails 76 run parallel with the ramped track 75. In this case, there are four guard rails 75, with two being disposed to the interior of the track 75 and two being disposed to the exterior of the track 75 adjacent the sides 81 and 82. However, fewer than four guard rails 75 may be used, for example, there may only be two guards rails 75, which are both disposed to the interior of the track 75.

Each guard rail 76 includes a bottom surface 91 coupled with the top surface 78 of the ramp base plate 74, and a sloped top surface 92 corresponding with the sloped top surface 88 of the ramped track 75 such that the top surface 88 of the ramped track 75 and the top surface 92 of the guard rails 76 are generally aligned. In some embodiments, the top surface 92 of the guard rails 76 may be higher or lower than the sloped top surface 88 of the ramped track 75. The guard rails 76 may also include gussets, braces, or other support structures to provide additional strength and rigidity. Each one of the pair of rail clamps 17 is attached to a respective side 81 and 82 of the ramp base plate 74 at a lock pivot bracket 93 that is coupled to the ramp base plate 74.

Figure 26:
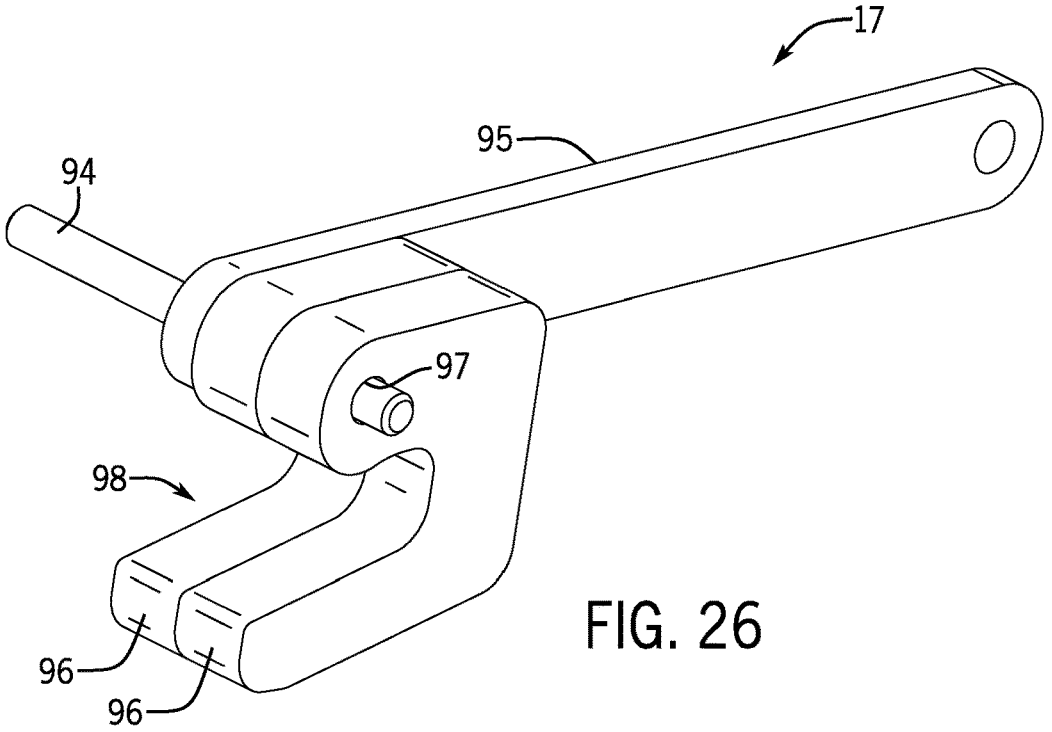
FIG. 26 is a perspective view of a rail clamp, according to one aspect of the disclosure.

FIG. 26 shows and example rail clamp 17, according to aspects of the present disclosure. The rail clamp 17 comprises a pivot bar 94, a handle 95, and one or more locking plates 96. The pivot bar 94 is a cylindrical rod that is configured to be fixedly coupled to the lock pivot bracket 93, and extends parallel to the sides of the ramp base plate 74. The handle 95 is configured to receive the pivot bar 95, thereby allowing the handle 95 to rotate about the pivot bar 94.

Each of the locking plates 96 are fixedly connected with the handle 95 and define a hole 97 through which the pivot bar 94 extends. Each of the locking plates 96 defines a channel 98 configured to receive and connect with the railroad track 28. The handle 95 and the one or more locking plates 96 rotate as a single unit about the pivot bar 94 between an unlocked position, where the rail clamp 17 is not in contact with an existing track, and a locked position, where the channel 97 of the one or more locking plates 96 couples with an existing track, thereby securely connecting the ramp section 16 with the railroad track 28.

Figure 27:
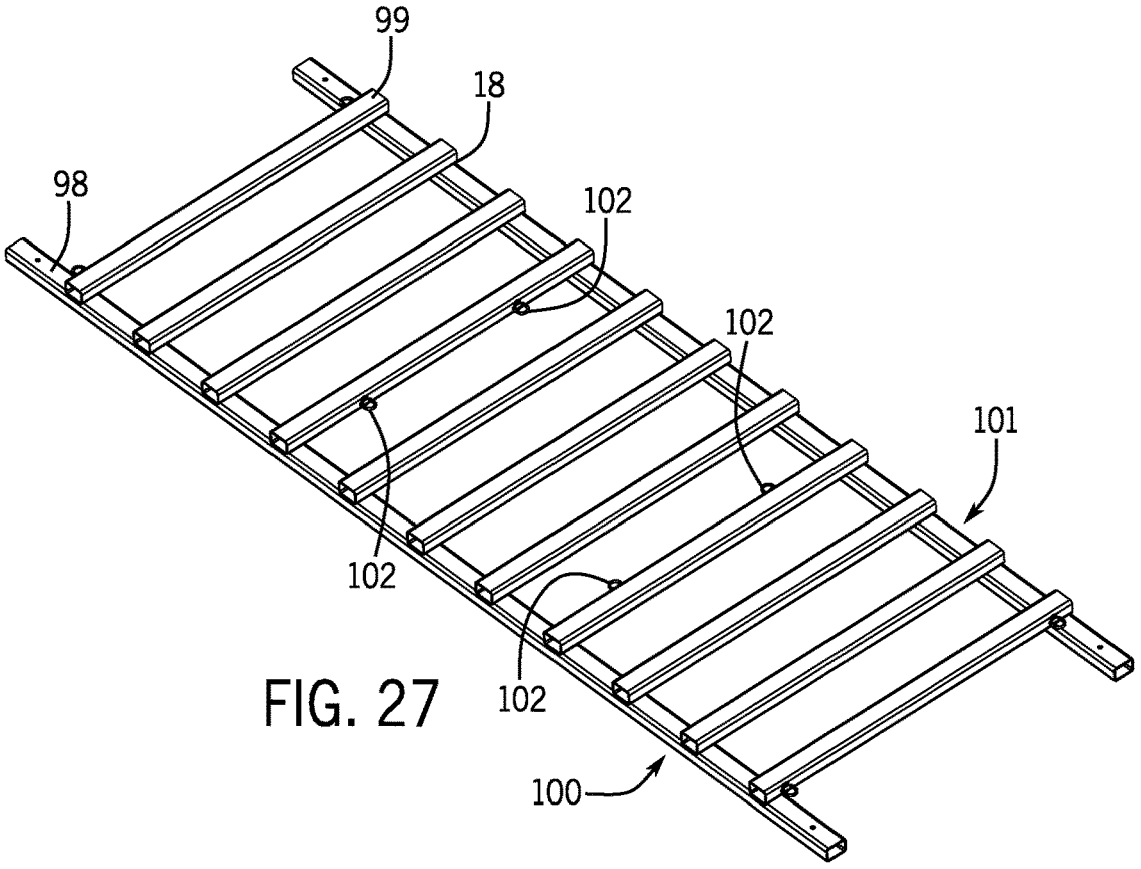
FIG. 27 is a perspective view of a support frame, according to one aspect of the disclosure.

FIG. 27, shows an example support frame 18, according to aspects of the disclosure. The support frame 18 has two longitudinal members 98 connected by a multitude of cross members 99. The support frame 18 defines a bottom portion 100 near the longitudinal members 98, configured to provide a stable connection with the ground. The support frame 18 further defines a top portion 101 adjacent the cross-members 99, configured to provide support to the bottom face 54 of a track base plate 50 or a bottom face 77 of a ramp base plate 74, thereby providing vertical support to the track sections 14 and ramp sections 16. Additionally, depending on the configuration of the track switch 10, the support frame 18 may also include attachment brackets 22 for an actuator system 24, for example, a hydraulic actuator, and/or lifting points 102 to facilitate movement of the support frame 18 during transport and installation.

It should be understood and appreciated that any number or configuration of support frames 18 may be utilized, depending on the requirements of the specific use case scenario. Any support frames 18 are preferably arranged to provide support to the various track sections 14 and ramp sections 16 of the track switch 10 so that the track switch 10 is fully supported anywhere between the open position and the closed position.

Within this specification embodiments have been described in a way which enables a clear and concise specification to be written, but it is intended and will be appreciated that embodiments may be variously combined or separated without parting from the invention. For example, it will be appreciated that all preferred features described herein are applicable to all aspects of the invention described herein.

Thus, while the invention has been described in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein.

Various features and advantages of the invention are set forth in the following claims.

We claim:

1. A track switch comprising:

a turntable section;

a plurality of track sections coupled together to form a single track; and a pair of ramp sections coupled to opposing ends of the single track, wherein one of the plurality of track sections is rotationally coupled to the turntable section by a pivot pin to allow the single track to rotate with the ramp sections about the pivot pin and relative to the turntable section to selectively connect a first railroad track to a second railroad track.

2. The track switch of claim 1, wherein the turntable section comprises ballast frame, a bearing base plate coupled with the pivot pin, and a bearing plate.

3. The track switch of claim 2, wherein the ballast frame further comprises two longitudinal members connected by a plurality of substantially perpendicular cross members.

4. The track switch of claim 2, wherein the ballast frame is coupled with the bearing base plate, so that the pivot pin extend upwardly, away from the ballast frame.

5. The track switch of claim 2, wherein the bearing plate defines a central hole through which the pivot pin extends, thereby allowing the bearing plate to rotate about a central axis of the pivot pin.

6. The track switch of claim 1, wherein each of the plurality of track sections further comprise a track base coupled with a track running lengthwise along the track base.

7. The track switch of claim 6, wherein the track base plates defines a hole configured to receive the pivot pin to provide a rotatable connection about pivot pin.

8. The track switch of claim 7, wherein the hole of the track base plate is disposed generally in the center of the track base plate.

9. The track switch of claim 6, wherein the track base plate is configured to fixedly couple with a connection plate at each end of the track base plate.

10. The track switch of claim 9, wherein a corresponding number of connection plates are provided to connect between each of the track sections.

11. The track switch of claim 1, wherein the ramped section comprises a ramp base plate, an angled track, at least two guard rails, and at least two rail clamps.

12. The track switch of claim 11, wherein the ramp base plate is configured to be placed on top of one of the first railroad track and the second railroad track.

13. The track switch of claim 11, wherein the ramp base plate includes ramped sections at a first distal end.

14. The track switch of claim 13, wherein the ramp base plate is configured to fixedly couple with a connection plate at a second distal end opposite the ramped sections, wherein the connection is configured to connect between a ramp section and a track section.

15. The track switch of claim 13, wherein the angled track slopes substantially upward from a generally pointed end adjacent the ramped sections, along the length of the ramped section, and terminating at a wide end adjacent a second distal end opposite the first distal end.

16. The track switch of claim 11, wherein the at least two guard rails run parallel to the angled track.

17. A method for selectively coupling a track switch to a railroad track comprising:

connecting a plurality of track sections together to form a single track;

connecting a ramp section to each end of the single track;

coupling a turntable section to one of the plurality of track sections with a pivot pin to enable the ramp sections to rotate relative to the turntable section; and rotating the single track together with the ramp sections about the pivot pin from a closed position where the ramp sections are misaligned with an existing track to an open position where the ramp sections are aligned with the existing track.

18. The method of claim 17, wherein rotating the single track from the open position to the closed position is provided by a rotatable connection formed by a hole in one of the plurality of track sections receiving the pivot pin, the pivot pin being fixed to the turntable section.

19. The method of claim 17, further comprising:

fastening the ramp sections to the existing track by pivoting a pair of rail clamps coupled to the ramp sections.

* * * * *